United States Patent [19]

Salisbury

[11] Patent Number: 4,660,342

[45] Date of Patent: Apr. 28, 1987

[54] ANCHOR FOR MORTARLESS BLOCK WALL SYSTEM

[76] Inventor: Jeffery Salisbury, 301 Barrington Rd., Syracuse, N.Y. 13214

[21] Appl. No.: 784,792

[22] Filed: Oct. 4, 1985

[51] Int. Cl.[4] ..... E04F 13/04

[52] U.S. Cl. ..... 52/358; 52/379; 52/713

[58] Field of Search ..... 52/358, 597, 699, 700, 52/703, 712, 713, 379, 513, 562, 607, 606

[56] References Cited

U.S. PATENT DOCUMENTS

| | | | |
|---|---|---|---|
| 2,705,887 | 4/1955 | Xanten | 52/712 X |
| 3,277,626 | 10/1966 | Brynjolfsson et al. | 52/379 X |
| 3,377,764 | 4/1968 | Storch | 52/713 |

FOREIGN PATENT DOCUMENTS

| | | | |
|---|---|---|---|
| 256782 | 4/1962 | Australia | 52/713 |
| 1082943 | 3/1971 | Canada | 52/562 |
| 1473234 | 1/1966 | France | 52/379 |
| 822767 | 10/1959 | United Kingdom | 52/379 |

*Primary Examiner*—William F. Pate, III

*Assistant Examiner*—Creighton Smith

*Attorney, Agent, or Firm*—Bruns and Wall

[57] ABSTRACT

An anchor for use in association with a mortarless block wall system for attaching facing to the outside of a wall. The wall includes a series of blocks placed in linear courses or rows with each block containing a pair of parallel sidewalls that are connected by lateral walls and at least one upwardly disposed projection for interlocking one block to another. At least one of the sidewalls has a laterally disposed groove formed therein which passes downwardly through the top surface of the block and is located adjacent to an end face on one of the lateral connecting walls. A wire anchor is seated within the groove which has an inwardly extended locking member that engages the connecting wall of the block. The anchor further contains a forwardly extended closure key that is adapted to pass over the outside face of the block. The closure key and locking member coact, in assembly, to hold the anchor securely to the block. A connecting member projects outwardly from the closure key and is used to couple the anchor to the facing material.

26 Claims, 12 Drawing Figures

ANCHOR FOR MORTARLESS BLOCK WALL SYSTEM

BACKGROUND OF THE INVENTION

This invention relates to an anchor for joining facing material to a mortarless block wall and in particular to a single piece wire anchor that can be securely joined to a mortarless block without the use of a bonding material.

In a mortarless block wall system, the blocks are laid in a conventional manner in horizontally disposed rows of courses with the vertical joints between abutting blocks being staggered. As more thoroughly described in U.S. Pat. No. 3,888,060, filed in the name of Haener, each of the mortarless blocks utilized in the wall system contains interlocking projections that allow the staggered blocks to be securely attached one to the other in assembly. The blocks are generally cast or poured from concrete so each contains a pair of parallel sidewalls that are connected by laterally extended walls. Through means of this construction a hollow core is formed within the block into which mortar or any other similar bonding material can be poured to internally join the blocks in assembly. In any event, the use of mortar or grouting in the block joint is eliminated thus dispensing with the need for skilled craftsmen and the like when erecting a wall. As a result, the block wall system and similar structures can be built rapidly and with a minimum amount of expense when compared to similar structures using more conventional mortared joints.

In many block wall applications, it is desirous to place a facing material or facade over one or both outside surfaces of the wall for either functional or aesthetic reasons. The term facings, as herein used, refers to any type of material that is known and used in the art for this purpose and may include such things as brick, modular panels and/or wall partitions. To preserve the integrity of the composite structure, the facing material is usually attached to the block wall using some type of retaining means. Conventionally, in a mortared system, a series of ties are laid within the block joints and mortared directly into the wall as it is being erected. The ties extend outwardly from the face of the wall and provide anchor points for attaching facing. The ties normally are metal elements having a connector that can be easily secured to the facing material.

Conventional ties, however, cannot be used in a wall that has no mortared joints. Placing ties on anchors in a mortarless wall system can involve attachments that require holes to be formed in the finished wall which tend to degrade and weaken the wall structure. These after attached anchors mauy work loose after installation further degrading the integrity of the overall structure.

SUMMARY OF THE INVENTION

It is therefore an object of the present invention to improve mortarless block systems used in the building industry.

It is a further object of the present invention to improve mortarless block wall systems by providing an anchor for attaching facings to the outside of the wall without comprising the integrity of the system or weakening the overall structure.

Another object of the present invention is to provide a secure anchor for use in conjunction with a mortarless wall system that is relatively inexpensive to manufacture and install and which cannot pull out after installation.

Yet another object of the present invention is to provide apparatus for attaching facing materials to a mortarless block wall which is formed from a single piece of wire and which can be securely anchored within the block without the use of special tools and the like.

These and other objects of the present invention are attained by means of an anchor for use in association with a mortarless block wall system for attaching facing materials to the outside of the wall that includes a series of blocks placed in linear courses. Each block contains a pair of parallel sidewalls that are joined by a series of lateral connecting walls and at least one upwardly disposed projection for locking the block to an overlying block in the wall system. A laterally disposed groove is formed in at least one of the sidewalls which passes downwardly through the top surface of the block adjacent to the end face of one of the lateral connecting walls. A single piece wire anchor is seated within the groove which has an inwardly extended locking member that is arranged to engage a part of the block structure. The anchor further contains a forwardly extended closure key that is adapted to seat against the outside face of the block to prevent the anchor from moving in assembly. A connecting arm projects outwardly from the closure key that permits the anchor to be quickly tied to the facing material.

BRIEF DESCRIPTION OF THE DRAWINGS

For a better understanding of these and other objects of the present invention, reference is had to the following detailed description of the invention which is to be read in conjunction with the accompanying drawings, wherein like components are identified by the same numbers throughout.

DESCRIPTION OF THE INVENTION

Figure 2:
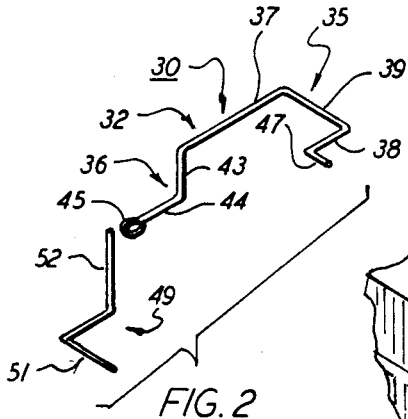
FIG. 2 is an exploded view in perspective showing the wire anchor and tie member utilized in the system shown in FIG. 1.
Figure 1:
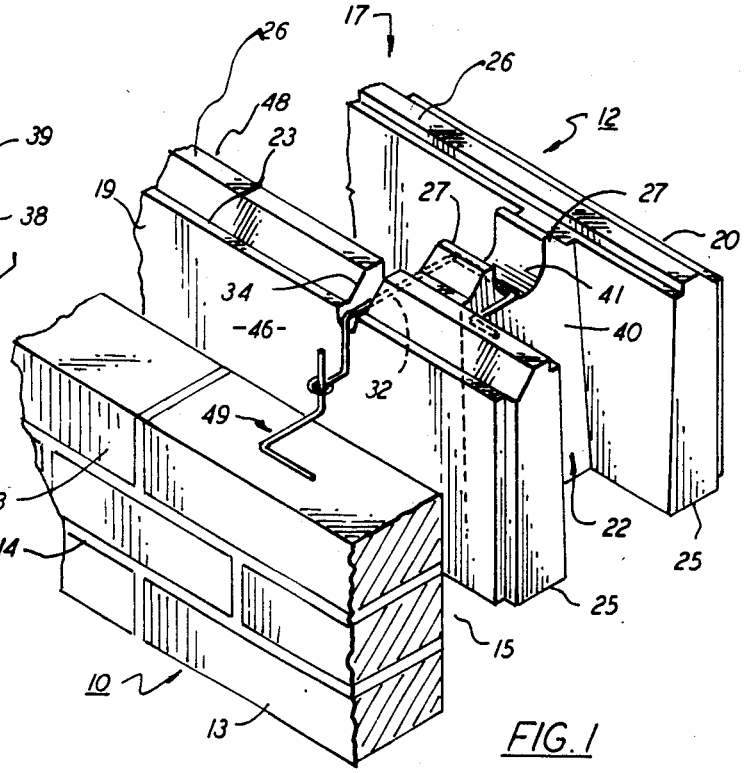
FIG. 1 is a perspective view showing a mortarless block wall system utilizing a wire anchor embodying the teachings of the present invention which is used to attach a brick facing to the outside surface of the block wall.
Figure 3:
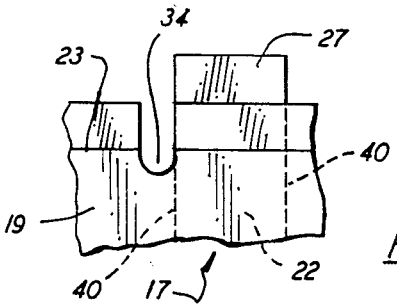
FIG. 3 is a partial front elevation showing the face of an anchor receiving a block used in the wall system of FIG. 1, further illustrating a receiving groove formed therein for accepting an anchor.
Figure 7:
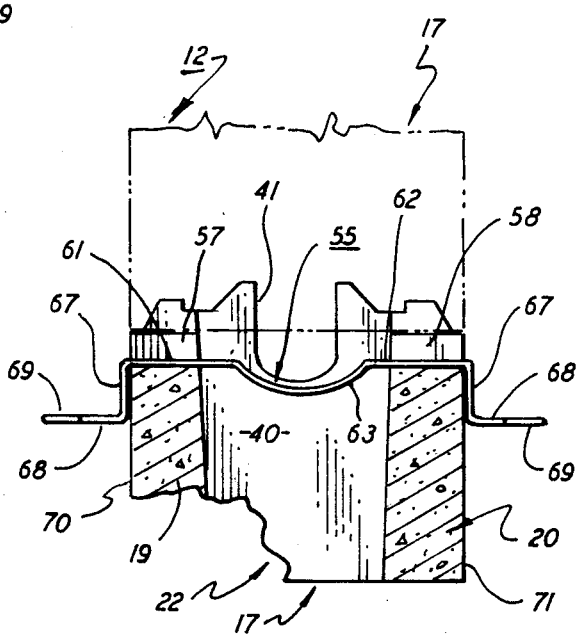
FIG. 7 is an end view in section showing the anchor illustrated in FIG. 6 set into a block wall.

Turning initially to FIGS. 1 through 3, there is shown one embodiment of the present invention relating to an anchor for attaching facing to a mortarless block 17 used in a wall system, generally referenced 12 (See FIG. 7). In this particular case, the facing involves a brick wall 10 containing a series of bricks 13—13 that are bonded together in a conventional manner using mortar 14 or any other suitable bonding material for creating both vertical and horizontal joints for holding the bricks together in assembly. The bricks are laid in a staggered relationship along rows or courses immediately in front of the block wall 12. An air space 15 is established between the two walls to provide a vapor and/or thermal barrier. Although a brick facade is described as the facing material in regard to this disclosure, it should be clear to one skilled in the art that the facing material may be varied without departing from the teachings of the present invention and may include any material such as panels, wall board or partitions as known and used in the building industry.

The mortarless block wall 12 is formed by joining together a series of concrete blocks, one of which is depicted at 17, which are physically interlocked in assembly to provide a strong, self-supporting structure. This type of block is described in greater detail in the above noted Haener patent and the disclosure set forth in the Heaner patent is incorporated herein by reference to the extent necessary for a more thorough understanding of the construction of this type of mortarless wall structure.

As described by Haener, each wall block contains a pair of spaced apart vertically aligned sidewalls 19 and 20 that are held in parallel relationship by means of a series of lateral connecting walls, one of which appears at 22. The block walls cooperate so that top seating surfaces 23—23 and bottom seating surfaces 25—25 of the block lie in parallel planes so that the block can be stacked one upon the other to form a vertical wall.

Each block is equipped with one or more upwardly extended projections 27—27 which protrude beyond the top plane of the block as described by the surfaces 26—26. As described by Haener, the projections are uniquely designed to interlock inside an overlying block to securely co-join each of the blocks in assembly. The projections preferably are formed as an integral part of at least one lateral connecting wall 22 to provide additional strength to the structure and to efficiently join the blocks in assembly. As noted above, the blocks are typically fabricated of concrete and are cast or poured in reusable molds to furnish each block with a precise geometry and contour.

Because the present blocks do not require mortars at the joints, a conventional facing tie cannot be employed in the assembly. A unique single piece wire anchor, generally referenced 30 (FIG. 2), is used in the present system to couple a tie 49 to the block wall as shown in FIG. 1. The anchor consists of three basic sections which include a linear rod 32 adapted to be seated within a lateral groove 34 formed in one sidewall 19 of the block 17, a rearwardly disposed locking member 35 for engaging lateral connecting wall 22 of the block and a forwardly disposed closure key 43 that coacts with the locking member 35 to securely hold the anchor to the block. The locking member is made up of a U-shaped bracket having two side arms 37 and 38 that are joined by means of a base leg 39 which is seated in connecting wall recess 41. The bracket arm 37 is, in practice, a rearwardly disposed extension of the rod 32. The front section of the rod on the other hand is bent or turned 90 degrees to create the closure key 43. The key, in turn, is again turned 90° to form an outwardly disposed connecting arm 44 which terminates with an eyelet 45. The key 43, connecting arm 44 and eyelet 45 all combine to establish a forwardly disposed linking unit generally referenced 36.

In assembly, the groove 34 is arranged to pass downwardly through the top surface 26 of sidewall 19. The groove extends laterally through the sidewall and opens into the interior of the block immediately adjacent to the inside end face of lateral connecting wall 22. The connecting wall has a saddle shaped semicircular recess 41 formed therein which passes downwardly through the wall to a depth that positions the bottom of the recess below the surface 23 on the sdiewall.

The inside dimension between the two side arms 37 and 38 of the locking member is preferably equal to or slightly less than the thickness of the connecting wall 22. The anchor is joined to the block by inserting the linear rod 32 into the groove 34 so that the locking member is positioned over the connecting wall 22 and the closure key 36 is adjacent to the outside face 47 of the block. The anchor is pressed downwardly into the block so that the base leg 39 of the U-shaped bracket is moved into the recess 41 with the bracket arms 37 and 38 being positioned on either side of the connecting wall as shown in FIG. 1. A horizontally disposed stabilizing bar 47 depends from the terminal end of bracket arm 38 and is adapted to contact the back face 48 of sidewall 19. The lateral distance between the closure key 43 and the stabilizing bar 39 is preferably equal to or slightly less than the thickness of sidewall 19 so that the anchor is slightly déformed as it is seated within the block. The anchor wire is formed of a galvanized steel material having a modulus of elasticity such that the wire will bend but not deform as it is seated within the block. The anchor is caused to be biased against the block thus holding the anchor tightly in place and preventing it from shifting either laterally or longitudinally in assembly.

As can be seen, the anchor is thus secured to the block without the aid of mortar or other bonding materials to provide an extremely stable platform upon which facing materials can be attached to the block wall. Turning once again to FIGS. 1 and 2, a tie wire 49 is used to couple the anchor to the brick facing. The tie wire includes an L-shaped base 51 from which depends a vertical shank 52. In assembly, the base is seated upon the last course of bricks that has been laid so as to support the shank in a vertical upright position as shown. The shank is passed upwardly through eyelet 45 of companion anchor 30. The assembly is completed by mortaring the tie in place in a conventional manner and laying the next course of brick thereover. The tie 49 shown in the drawings is known in the trade as a type Z adjustable tie which is provided by the A-A Wire Product Company of Chicago, Ill., under the identification No. AA 305.

Figure 5:
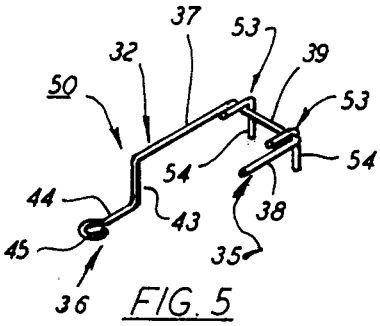
FIG. 5 is a perspective view of the anchor utilized in the embodiment shown in FIG. 4.
Figure 4:
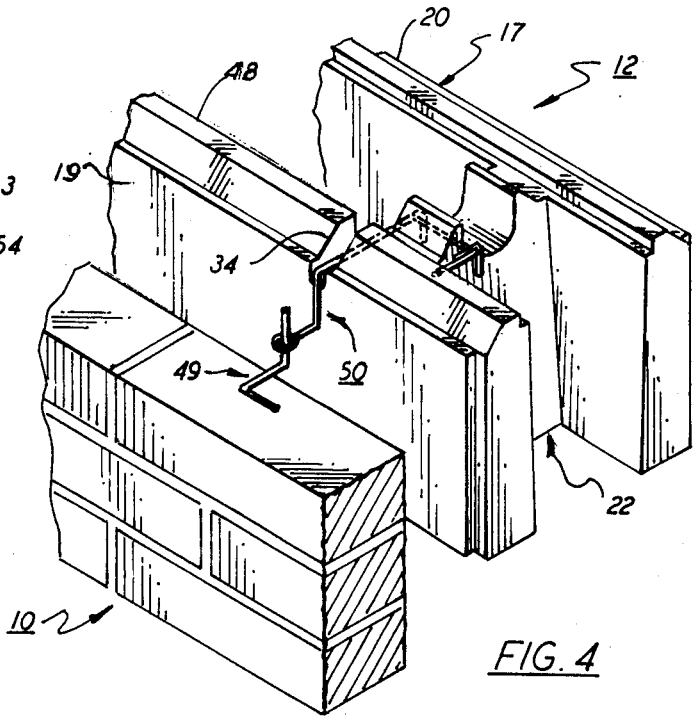
FIG. 4 is a perspective view similar to that shown in FIG. 1, further illustrating another form of anchor embodying the teachings of the present invention.

FIGS. 4 and 5 show an anchor 50 that is similar in construction to that shown in FIGS. 1-3 wherein like numbers are used to identify like parts. In this embodiment, the stabilizing bar has been removed from the distal end of bracket leg 38. The end of the leg 38 is extended slightly so that the distance between its distal end or free end and the locking bar 43 is now slightly less than the thickness of the block sidewall 19. Accordingly, when the locking bar is mounted as shown in FIG. 4, the anchor will again exert a biasing pressure over the sidewall 19 of the block to secure the anchor in assembly. A pair of angles 53—53 are welded to the base end of arms 37 and 38 of the U-shaped mounting bracket. The angles are adapted to pass downwardly over the two apposed end faces of the connecting wall 22. Each angle contains a stabilizing bar 54 which protrudes downwardly a sufficient distance along the adjacent surface of the wall to prevent the anchor from shifting longitudinally in assembly.

Figure 6:
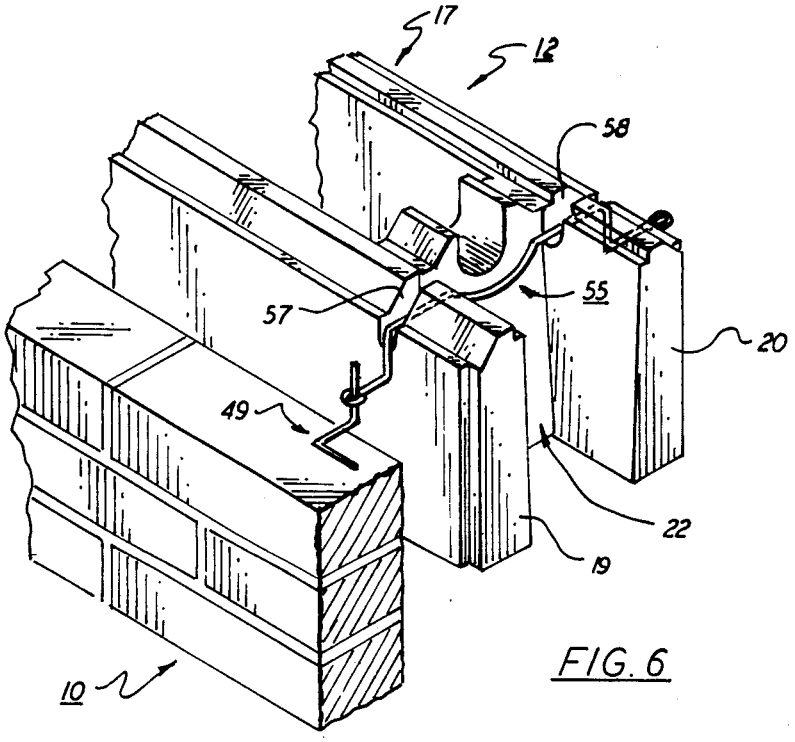
FIG. 6 is a further perspective view of a mortarless block wall system showing another embodiment of the present anchor wherein the anchor is arranged to attach facing materials on both sides of the block wall.
Figure 8:
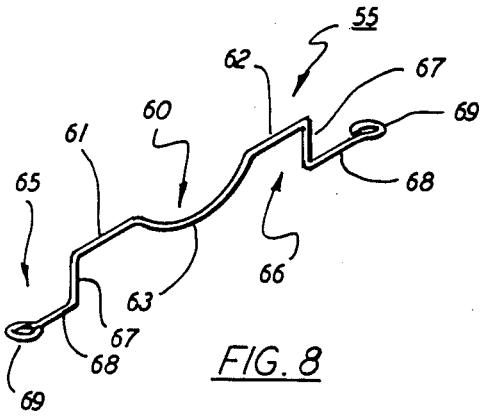
FIG. 8 is a perspective view of the anchor shown in FIGS. 6 and 7.

Turning now to FIGS. 6–8, there is shown an anchor 55 that is utilized to attach facing to both sides of the block wall 12. In this embodiment of the invention, a pair of axially aligned, laterally extended grooves 57 and 58 are formed as described above in opposing sidewalls 19 and 20, of a block 17. As previously noted, each groove passes out of the sidewall immediately adjacent to the end face 40 of the connecting wall 22 (FIG. 2). The anchor includes a centrally located locking member, generally referenced 60, made up of two coaxially aligned rods 61 and 62 that are joined by means of an arcuate shaped leaf spring 63. A pair of closure keys 67—67 depend from either end of the locking member 60. Linking units 65 and 66 each include a closure key, a connecting arm 68 and a terminal eyelet 69. Each closure key is perpendicularly disposed with regard to the rod to which it is joined and the keys are adapted to pass over the opposing outer faces of the block. The connecting arms protrude outwardly from the two outer faces of the block to allow the anchor to be attached to facing materials on either side of the wall.

The two closure keys 67—67 of the anchor are spaced apart at a predetermined distance that is equal to or slightly less than the overall thickness of the block 17 as measured over the two sidewalls. In assembly, the rods 61–62 are passed into the receiving grooves 57 and 58, respectively. Under the influence of the spring, the two keys are biased into holding contact against the opposed wall surfaces of the block to lock the anchor in assembly. With the rod well seated in the receiving grooves, the body of spring 63 rests in contact against the end face 40 of the connecting wall 22.

Figure 10:
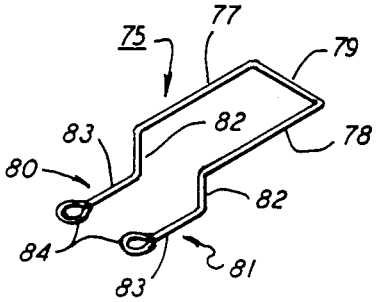
FIG. 10 is a perspective view of the anchor shown in FIG. 9.
Figure 9:
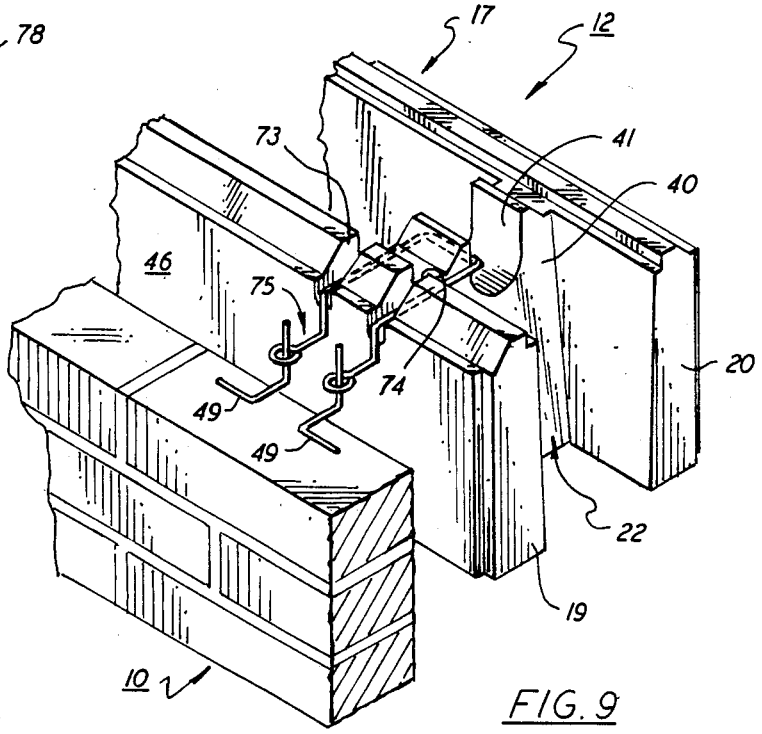
FIG. 9 is also a perspective view showing a mortarless block system utilizing a still further embodiment of an anchor embodying the teachings of the present invention.

FIGS. 9 and 10 illustrate another embodiment of the invention in which a pair of anchor receiving grooves 73 and 74 are formed in one sidewall 19 of block 17. The grooves are arranged to open on either side of the connecting wall 22 adjacent to the opposing end faces of the wall. The anchor 75 contains a U-shaped locking member 76 that is made up of two parallel arms 77 and 78 which are joined together by means of a base leg 79. A pair of closure keys 82—82 are connected to the terminal ends of the two locking member arms. The two linking units 80 and 81 each include a closure key 82, a connecting arm 83 and an eyelet 84.

In assembly, the two arms of the locking member are passed into receiving grooves 73 and 74 with the base leg 79 of the members situated within the recess 41 formed in the connecting wall 22. The spacing between the locking member arms is such that the arms again will be biased, in assembly, against the two end faces of the connecting wall to exert a slight pressure against the wall to secure the anchor in assembly. The closure keys 82—82 are mounted at the distal ends of the arms 77 and 78 in perpendicular alignment therewith and extend downwardly over the outer face 46 of the sidewall 19. The distance between the two locking bars and the base leg of the locking member is such that a lateral biasing pressure is also exerted by the anchor upon the block which further helps to secure the anchor in assembly. The linking units protrude outwardly from the front face of the wall and are employed to attach any type of facing to the front face of the block wall.

Figure 12:
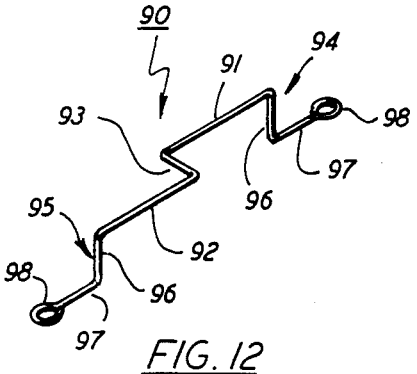
FIG. 12 is a perspective view of the anchor shown in FIG. 11.
Figure 11:
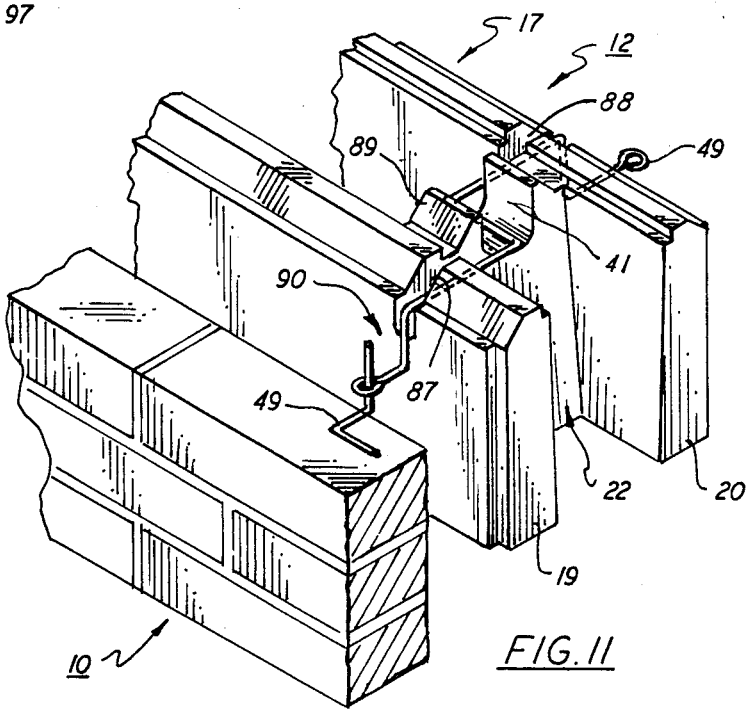
FIG. 11 is a perspective view of a mortarless block wall showing yet another anchor embodying the teachings of the present invention.

With reference to FIGS. 11 and 12, there is shown an anchor 90 that is again adapted to attach facing material to both sides of a block wall. In this embodiment of the invention, a first groove 88 is placed in the front sidewall 19 of the block adjacent to end face 40 of connecting wall 22. A similar groove 88 is placed in the opposing sidewall 20 adjacent to the opposite end face 89 of the wall. The anchor includes a pair of offset retaining rods 91 and 92 that are joined together by means of a longitudinal arm 93. Closure keys 96—96 are joined to the distal ends of the two retaining bars as shown. Linking units 94 and 95 each include a key 96, a connecting rod 97 and an eyelet 98 which is used, as explained above, to attach facings to both sides of the block wall. The lateral distance between the two closure keys is slightly less than the overall thickness of the cement block 17 measured across the two sidewalls 19 and 20. In assembly, the two anchor rods are inserted into the receiving grooves 87 and 88 while the leg 93 is received within the recess 41 formed in the connecting wall 22. In assembly, the closure keys are biased outwardly to permit the anchor to be firmly seated within the block as shown in FIG. 11. Upon release of the closure keys, the keys move into biasing contact against the opposed outside faces of the brick to securely hold the anchor in place. Here again, the anchor is mechanically held to the block so it cannot shift its position either laterally or longitudinally. In this arrangement, the connecting rods protrude outwardly from both faces of the block and are thus available for use in attaching any type of facing or facade to either side of the wall.

Each of the anchors herein described is formed from a single piece of galvenized steel wire that preferably is in conformity with ASTM standards covering this type of anchor assembly.

While this invention has been described with specific reference to the structure disclosed herein, it is not necessarily confined to the details as set forth and this application is intended to cover all modifications and changes that may come within the scope of the following claims.

I claim:

1. In a mortarless block wall system, apparatus for attaching facing to the wall that includes a structure formed of a plurality of interlocking blocks that are placed one on top of the other in linear courses, each block in said structure being a hollow member having two spaced apart parallel sidewalls that are connected by at least one lateral connecting wall, one sidewall of each block having a lateral groove passing downwardly through its top surface, said groove being positioned adjacent to one end face of the connecting wall, said connecting wall further having a longitudinally disposed recess in the top thereof that extends between its two end faces, a wire anchor that includes a linear rod seated in said groove; a U-shaped locking bracket section that straddles the connecting wall having a first side leg integral and coaxial with the back of said rod so that said leg parallels one end face of the connecting wall, a base leg that is seated in the recess of the connecting wall, and an opposing side arm that parallels the opposite end face of the connecting wall; a closure key integral with the front of said rod having a locking arm that is perpendicular to the rod and parallels the front face of said one sidewall, and means to attach facing to said anchor.

2. The apparatus of claim 1 that further includes a connecting means that extends outwardly from the closure key which is arranged to accept said means for attaching facing to said anchor.

3. The apparatus of claim 1 that further includes a stabilizing bar joined to the terminal end of said bracket arms that passes along the opposite end face of said one sidewall.

4. The apparatus of claim 3 wherein the distance between the closure key and the stabilizing bar is about equal to or slightly less than the thickness of the said one sidewall.

5. The apparatus of claim 1 wherein said U-shaped bracket further includes a vertically disposed member for contacting each end face of the connecting wall to prevent lateral movement of the anchor.

6. The apparatus of claim 1 wherein the anchor is made of a single piece of spring steel wire having a modulus of elasticity such that the anchor can be deformed into contact wtih the block without exceed its elastic limit.

7. The apparatus of claim 2 wherein said connecting means contains an eyelet for slidably receiving a tie wire therein.

8. In a mortarless block system, apparatus for attaching facing to the wall that includes a structure formed of a plurality of interlocking blocks that are placed one on top of the other in linear courses, each block in the structure being a hollow member having a pair of parallel sidewalls and at least one lateral connecting wall positioned between the sidewalls, one sidewall in some of the blocks having a pair of laterally extended grooves passing downwardly through the top surface thereof, said grooves being positioned on either side of the latter connecting wall, an anchor that includes a U-shaped bracket having a pair of opposed arms that are seated in said grooves and a base leg for joining the arms that passes through the lateral wall, a linear closure key joined perpendicularly to the terminal end of each bracket arm, each key extending downwardly along the front face of said one sidewall in parallel relationsihp therewith, and means to attach facing to either of the closure keys.

9. The apparatus of claim 8 that further includes a connecting arm joined to each locking bar that extends outwardly from the wall and a tie means for joining each link to said facing.

10. The apparatus of claim 9 wherein each connecting arm contains an eyelet for slidably receiving the tie means therein.

11. The apparatus of claim 8 wherein the anchor is made of a single piece of resilient steel wire.

12. In a mortarless block wall apparatus for attaching facing to the wall that includes a structure formed of a plurality of interlocking blocks placed one on top of the other in linear courses, at least some of the blocks in the structure having a pair of parallel sidewalls that are joined by at least one lateral connecting wall, one sidewall in said some of the blocks having a first lateral groove passing downwardly through its top surface adjacent to an end face on said connecting wall, the other sidewall of said some blocks having a second lateral groove passing downwardly through its top surface adjacent the opposite end face on said connecting wall, said connecting wall of said some of the blocks further including a recess formed in the top section thereof that has a bottom surface at about the same elevation as said grooves, an anchor for attaching facing to said some of the blocks that includes a linear rod seated in each of the grooves that extend into the block adjacent the opposing end faces of the connecting wall, an arm passing through the recess for joining the back of the two rods, a closure key joined perpendicularly to the front of each rod so that the closure key passes along the front face of each sidewall and means for attaching facing to each of said closure keys.

13. The apparatus of claim 12 wherein the distance between the two closure keys is substantially equal to the thickness of the block as measured over its two sidewalls.

14. The apparatus of claim 12 wherein the anchor further includes an outwardly disposed connecting arm joined to each of the closure keys.

15. The apparatus of claim 14 wherein each connecting arm contains an eyelet for slidably receiving therein a tie wire that is attached to said facing.

16. In a mortarless block wall, apparatus for attaching facing to the wall that includes a structure formed of a plurality of interlocking blocks placed one on top of the other in linear courses, each block in the structure having a pair of parallel sidewalls that are joined by at least one lateral connecting wall, each sidewall having a laterally disposed groove passing downwardly through its top surface adjacent to one end face on said connecting wall so that the two grooves are in axial alignment, an anchor that includes a pair of rods, each rod being seated in one of said grooves, an arcuate member positioned adjacent to said one end face of said connecting wall for joining the opposing ends of said rods, a closure key perpendicularly joined to the front of each rod so that the keys are parallelly aligned along the two outside faces of the sidewalls means for attaching facing to each of the closure keys.

17. The apparatus of claim 16 wherein the distance between the two closure keys is substantially equal to the width across the block as measured over the two sidewalls.

18. The apparatus of claim 16 that further includes a connecting arm joined to each closure key that extends outwardly from the face of the wall and which contains an eyelet for slidably receiving a facing tie thereon.

19. The apparatus of claim 16 wherein the anchor is formed from a single piece of resilient steel wire.

20. A wire anchor for attaining a facing material to a mortarless block that includes a pair of rods, one rod being arranged to pass through one sidewall of the block and the other rod being arranged to pass through the opposite sidewall of the block, means for joining the opposed ends of the two rods, a closure key joined perpendicularly to the other end of each rod so that the distance between each of said closure keys is substantially equal to the thickness of the block as measured over the sidewalls, a connecting arm joined to each closure key, each arm having an eyelet for receiving therein a tie means for attaching said facing, said rods being offset in a common plane and being joined by a cross member.

21. The anchor of claim 20 wherein the rods are axially aligned and are joined by an arcuate shaped spring.

22. The anchor of claim 21 wherein the rods are offset in a common plane and are joined by a cross member lying in said plane.

23. A wire anchor for attaching facing to a mortarless block structure that contains a plurality of hollow interlocking blocks placed one on top of the other in linear courses, said anchor including a linear rod of sufficient length so that it can pass into the block through one sidewall, a closure key joined to the front of the rod that includes an arm perpendicularly joined to the rod that extends in parallel alignment along an outside face of said block, a locking bracket integral with the back of the rod for engaging an interior portion of said blocks, said closure key and said locking bracket coacting to prevent the rod from moving axially out of the block, and attaching means for connecting facing to the locking key.

24. The anchor of claim 23 wherein the attaching means includes a connecting arm outwardly disposed from the closure key and a tie means for attaching the arm to a facing material.

25. The anchor of claim 24 wherein the connecting arm contains an eyelet for slidably receiving the tie means therein.

26. The anchor of claim 23 wherein said locking bracket is a U-shaped member having one arm that is integral with said rod.

* * * * *

UNITED STATES PATENT AND TRADEMARK OFFICE

CERTIFICATE OF CORRECTION

PATENT NO. : 4,660,342

DATED : April 28, 1987

INVENTOR(S) : Jeffery Salisbury

It is certified that error appears in the above-identified patent and that said Letters Patent is hereby corrected as shown below:

Column 9, line 7 - "attaining" should read "attaching".

Signed and Sealed this

Twenty-ninth Day of September, 1987

*Attest:*

DONALD J. QUIGG

*Attesting Officer* *Commissioner of Patents and Trademarks*